US006896253B2

(12) United States Patent
Hanabusa

(10) Patent No.: US 6,896,253 B2
(45) Date of Patent: May 24, 2005

(54) SHEET MATERIAL FEEDING APPARATUS AND RECORDING APPARATUS

(75) Inventor: Tadashi Hanabusa, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 11 days.

(21) Appl. No.: 10/137,378

(22) Filed: May 3, 2002

(65) Prior Publication Data

US 2002/0167124 A1 Nov. 14, 2002

(30) Foreign Application Priority Data

May 10, 2001 (JP) ..... 2001-139898

(51) Int. Cl.[7] ..... B65H 3/06

(52) U.S. Cl. ..... 271/117; 271/118; 271/121; 271/124; 271/125; 271/126

(58) Field of Search ..... 271/117, 118, 271/121, 122, 124, 125, 126, 256, 114, 10.09, 273, 274, 145, 119, 120

(56) References Cited

U.S. PATENT DOCUMENTS

| | | | | | |
|---|---|---|---|---|---|
| 4,627,607 | A | * | 12/1986 | Ishii | 271/122 |
| 4,928,951 | A | * | 5/1990 | Fukui | 271/113 |
| 5,004,217 | A | * | 4/1991 | Kano et al. | 271/10.11 |
| 5,244,191 | A | * | 9/1993 | Kanekura | 271/10.11 |
| 5,253,854 | A | * | 10/1993 | Tanoue et al. | 271/10.12 |
| 5,358,230 | A | * | 10/1994 | Ikemori et al. | 271/114 |
| 5,386,983 | A | * | 2/1995 | Ando | 271/118 |
| 5,470,052 | A | * | 11/1995 | Asakawa et al. | 271/118 |
| 5,655,762 | A | * | 8/1997 | Yergenson | 271/121 |
| 5,725,208 | A | * | 3/1998 | Miyauchi | 271/10.09 |
| 5,738,348 | A | * | 4/1998 | Yasue et al. | 271/118 |
| 5,738,452 | A | * | 4/1998 | Uchida | 400/624 |
| 5,775,823 | A | * | 7/1998 | Bekki et al. | 400/629 |
| 5,909,872 | A | * | 6/1999 | Takahashi | 271/116 |
| 5,934,664 | A | * | 8/1999 | Murayama et al. | 271/118 |
| 5,984,297 | A | * | 11/1999 | Tanaka | 271/118 |
| 5,992,993 | A | * | 11/1999 | Kiyohara et al. | 347/104 |
| 6,000,689 | A | * | 12/1999 | Furuki et al. | 271/10.11 |
| 6,059,281 | A | * | 5/2000 | Nakamura et al. | 271/119 |
| 6,082,729 | A | * | 7/2000 | Padget | 271/121 |
| 6,135,444 | A | * | 10/2000 | Padget | 271/121 |
| 6,354,584 | B1 | * | 3/2002 | Suga et al. | 271/10.12 |
| 6,378,858 | B1 | * | 4/2002 | Suga | 271/10.01 |
| 6,382,621 | B1 | * | 5/2002 | Inoue et al. | 271/120 |
| 6,382,622 | B1 | * | 5/2002 | Takada et al. | 271/122 |
| 6,467,767 | B2 | * | 10/2002 | Yano | 271/122 |
| 6,536,759 | B1 | * | 3/2003 | Takada | 271/125 |
| 6,547,237 | B2 | * | 4/2003 | Sugino et al. | 271/119 |

FOREIGN PATENT DOCUMENTS

| | | | | |
|---|---|---|---|---|
| JP | 04164723 | A | * 6/1992 | B65H/1/04 |

* cited by examiner

*Primary Examiner*—Donald P. Walsh
*Assistant Examiner*—Matthew J. Kohner
(74) *Attorney, Agent, or Firm*—Fitzpatrick, Cella, Harper & Scinto

(57) ABSTRACT

A sheet material feeding apparatus, provided with a simple-structure and low-cost multifeeding prevention mechanism, comprises a sheet stacker for stacking sheets, a feeding roller for feeding the stacked sheets, a separation roller, rotating according to the feeding roller, for separating the sheet, a separation roller holder for rotatably holding the separation roller and rotating to cause the separation roller to move to a position being in contact with the feeding roller and to a position being released from the feeding roller, and a urge unit for urge the sheet stacker to the feeding roller to cause the stacked sheets to come into contact with the feeding roller, wherein, after the separation roller came into contact with the feeding roller, it causes the stacked sheets to come into contact with the feeding roller.

32 Claims, 11 Drawing Sheets

SHEET MATERIAL FEEDING APPARATUS AND RECORDING APPARATUS

BACKGROUND OF THE INVENTION

1. Field of the Invention

The present invention relates to a sheet material feeding apparatus which takes a sheet material one by one from a sheaf of the plural stacked sheet materials and then transports the taken sheet materials, and more particularly, to a sheet material feeding apparatus which is provided with a mechanism for preventing so-called multifeeding (or overlap feeding) that plural sheet materials are fed together when a one-time feeding operation is performed.

2. Related Background Art

Conventionally, as an automatic sheet feeding apparatus which is provided with a multifeeding prevention mechanism of retard system, for example, there is provided a system in which an operation to urge a pressure plate for causing a stacked sheet to come into pressure-contact with a paper (or sheet) feeding roller into the paper feeding roller and to move (or shift) the pressure plate to release it from the paper feeding roller is driven by rotation of the shaft of the paper feeding roller with use of a cam on this shaft. In this system, when the pressure plate is urged to the side of the paper feeding roller, a contact speed between the sheet on the pressure plate and the paper feeding roller is restrained by driving the paper feeding roller at low speed, so as to reduce a crush sound made when the sheet comes into contact with the paper feeding roller.

Further, when a driving force from a motor is transmitted to the paper feeding roller, a planet gear clutch or the like might be used to transmit the driving force to other units in the middle of its transmission system. In this case, even if the motor is driven at low speed, the cam on the shaft of the paper feeding roller is pressed by a cam of the pressure plate, and a gear engaging portion of a planet gear is thus released, whereby an antecedent rotation phenomenon of the paper feeding roller occurs. Thus, the contact speed between the sheet and the paper feeding roller can not be restrained, whereby the crush sound can not be reduced resultingly.

As described above, in the conventional automatic sheet feeding apparatus, there are some restrictions in the case where the contact speed between the sheet on the pressure plate and the paper feeding roller is restrained and the crush sound made when the sheet comes into contact with the roller is thus restrained. That is, in the automatic sheet feeding apparatus which is provided with the pressure plate for causing the stacked sheet to come into contact with the paper feeding roller, since a driving source such as a motor or the like which is dedicated for the automatic sheet feeding apparatus is used, the apparatus becomes large in size and brings an increase in cost.

SUMMARY OF THE INVENTION

An object of the present invention is to provide a sheet material feeding apparatus and a recording apparatus which are provided respectively with simple-structure multifeeding prevention mechanisms for preventing the apparatuses from becoming large in size and bringing an increase in cost.

Another object of the present invention is to provide a sheet material feeding apparatus comprising: a sheet material stacking means for stacking sheet materials; a feeding roller for feeding the sheet materials stacked on the sheet material stacking means; a separation roller, rotating according to the feeding roller, for separating the sheet material; a separation roller holder for rotatably holding the separation roller, the separation roller holder rotating to cause the separation roller to move to a position being in contact with the feeding roller and to a position being released from the feeding roller; and an urging means for urging the sheet material stacking means to the feeding roller to cause the sheet materials stacked on the sheet material stacking means to come into contact with the feeding roller, wherein, after the separation roller came into contact with the feeding roller, it causes the sheet materials stacked on the sheet material stacking means to come into contact with the feeding roller.

DETAILED DESCRIPTION OF THE PREFERRED EMBODIMENTS

Hereinafter, the embodiments of the present invention will be explained with reference to the attached drawings.

Figure 1:
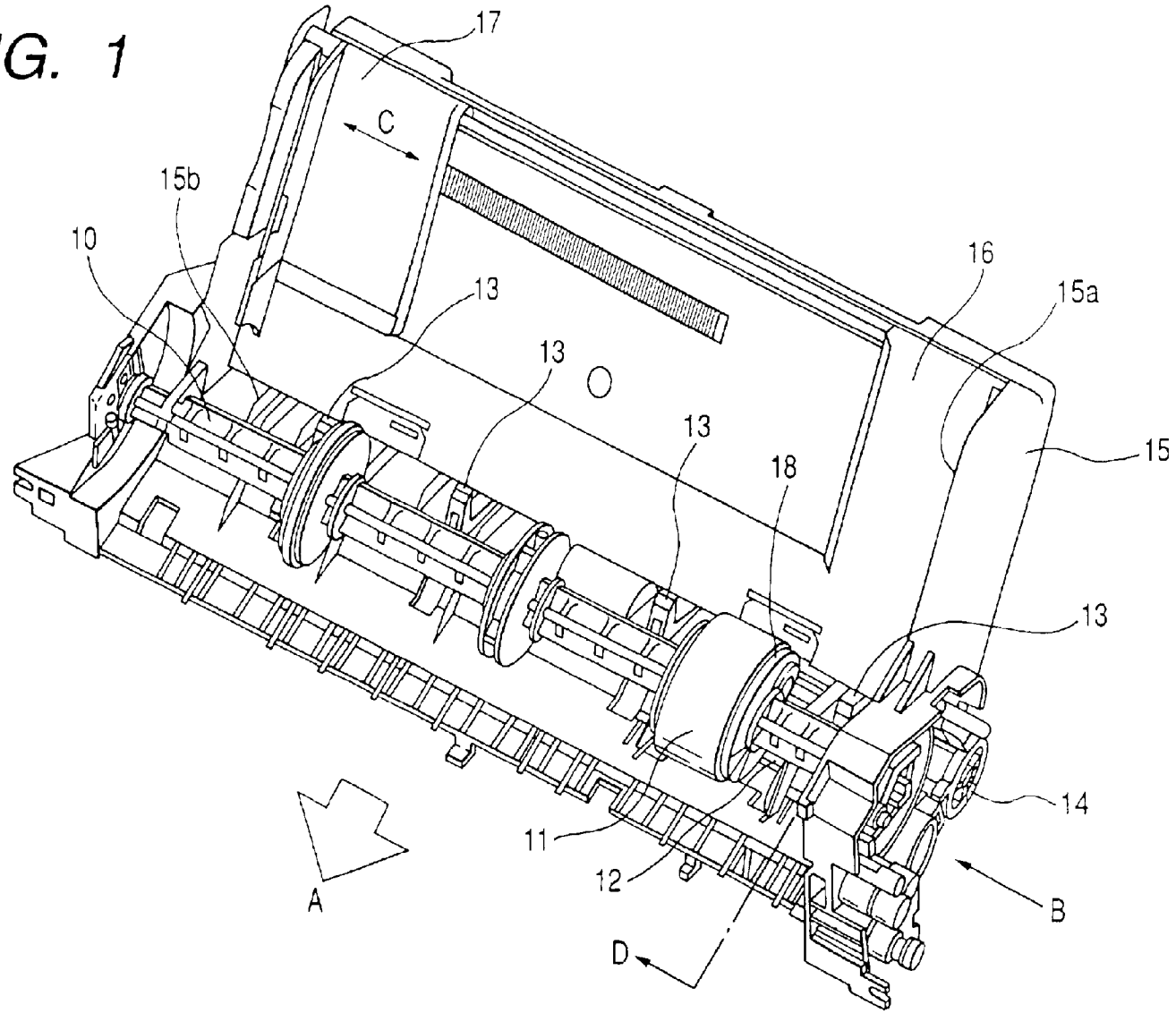
FIG. 1 is a perspective view schematically showing an entire structure of a sheet material feeding apparatus according to one embodiment of the present invention.

FIG. 1 is a perspective view schematically showing an entire structure of a sheet material feeding apparatus (also called an ASF (automatic sheet feeder)) according to one embodiment of the present invention.

Figure 2:
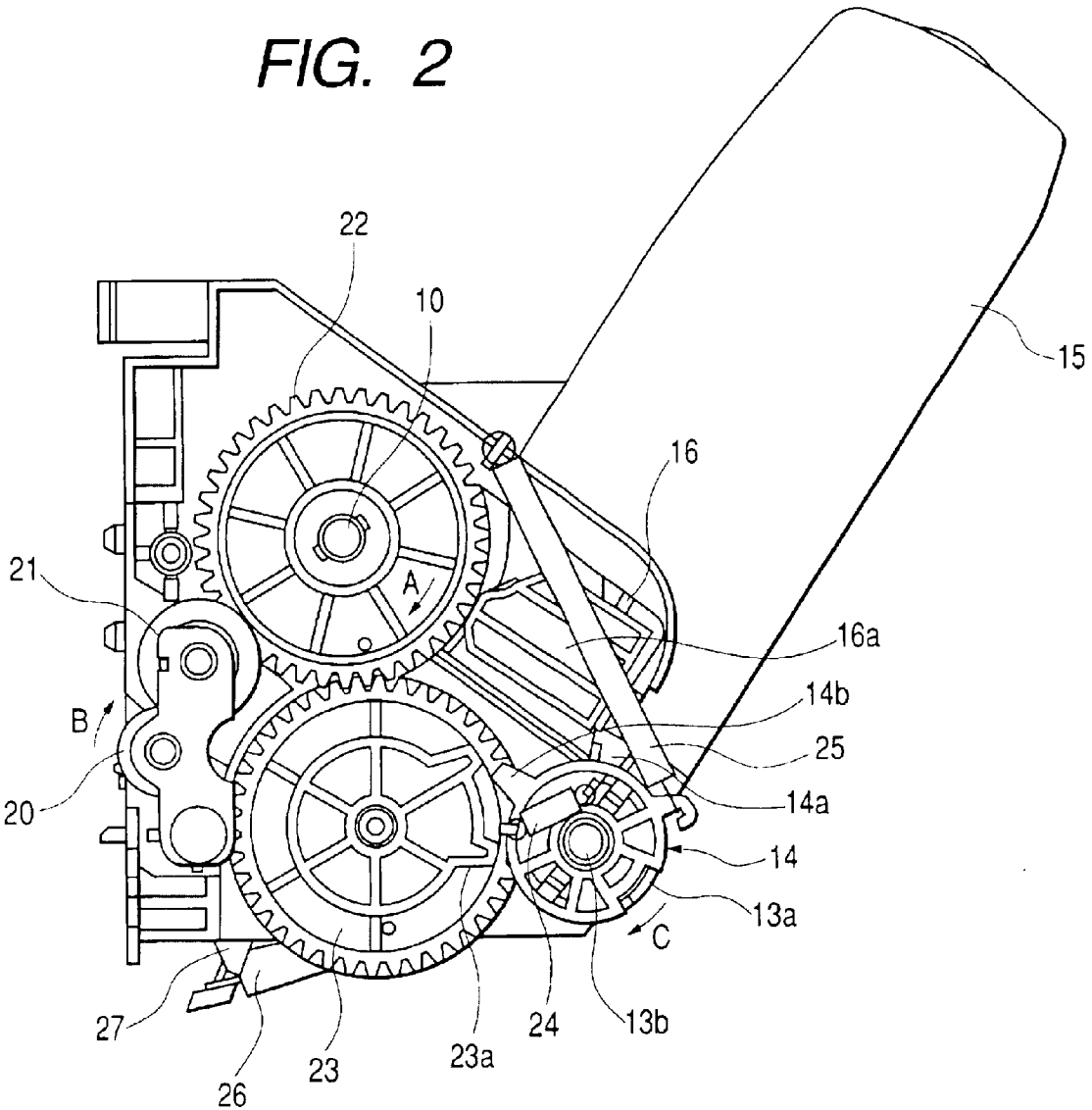
FIG. 2 is a schematic side view showing the sheet material feeding apparatus being viewed from a direction B of FIG. 1.

As shown in FIGS. 1 and 2, in the sheet material feeding apparatus according to the embodiment, a feeding shaft 10 is rotatably fit on an ASF base 15 which functions as a frame (framework) of the apparatus, a feeding roller 11 which feeds and transports sheet materials such as paper and the like is fit on a part of the feeding shaft 10, and the feeding roller 11 is rotatably supported by the feeding shaft 10 on the ASF base 15. Further, a feeding roller 18 which is to prevent the feeding roller 11 from being in contact with the sheet material when a rotation angle of the feeding roller 11 is within a predetermined range is rotatably fit on a portion of the feeding shaft 10 adjacent to the feeding roller 11. A separation roller 12 which is added with a torque limiter and functions as a friction separation means concerning an operation to separate the sheet material on the sheet material feeding apparatus is fit on the ASF base 15 through a holder 27 which rotatably supports the separation roller 12, as later described with reference to FIG. 2. Then, the separation roller 12 is pressed against the feeding roller 11 by springs fit on the holder 27 and the ASF base 15. In the embodiment, the separation roller 12 is rotatably supported so that the roller 12 is urged to the side of the feeding roller 11 to come into pressure-contact with the sheet material so as to nip this sheet material between the rollers 11 and 12 and is also rotated according to the movement of the sheet material nipped between the rollers 11 and 12.

Plural turn-back levers 13 which function as a turn-back member concerning with prevention of so-called multifeeding that the plural sheet materials from the sheet material feeding apparatus are fed and transported as they overlap each other are swingably fit on the ASF base 15, and each turn-back lever 13 is urged to one direction by a spring. A control cam 14 which is to drive the turn-back levers 13 is disposed at one end portion of the ASF base 15. The control cam 14 is fit on a member which drives the respective turn-back levers 13, and rotatably supported together with this member.

The ASF base 15 includes an inclined portion which is inclined in a use state, and a pressure plate 16 which functions as a pressing member for pressing a sheaf of the sheet materials against the feeding roller 11 is fit on the upper surface of the inclined portion. The pressure plate 16 is urged to the side of the feeding roller 11 by a not-shown pressure plate spring set between the pressure plate 16 and the ASF base 15, whereby the sheaf of the sheet materials stacked on the pressure plate 16 is pressed against the side of the feeding roller 11 by the pressure plate 16 and the pressure plate spring. Further, a side guide 17 is slidably fit on the pressure plate 16 in a direction C perpendicular to a sheet material transportation direction A of the feeding roller 11 as shown in FIG. 1. The side guide 17 is to position the sheet materials in the direction C on the pressure plate 16.

The sheet material feeding apparatus of the embodiment is designed on the premise that this apparatus is installed in another apparatus such as a recording apparatus or the like and thus used as one body of such another apparatus, whereby any driving source is not provided in the sheet material feeding apparatus itself. Therefore, the sheet material feeding apparatus of the embodiment is structured as a driven apparatus which is driven by receiving driving force transmitted from, e.g., the side of the body of the recording apparatus. In the followings, a case where the sheet material feeding apparatus is installed in the recording apparatus will be explained by way of example. However, the apparatus in which the sheet material feeding apparatus is to be installed is not limited to the recording apparatus.

The sheet material feeding apparatus of the embodiment is roughly composed of a sheet material stacking unit, a feeding/separation unit and a multifeeding prevention unit. First, a structure of the sheet material stacking unit will be explained.

The sheet material stacking unit of the sheet material feeding apparatus is composed of the side guide 17 and the pressure plate 16. Here, a sheet material transportation basis portion 15*a* which is provided to project from a part of the ASF base 15 is set as the basis on the side of the sheet material, and the side guide 17 is set to regulate the side edges of the sheet materials on the side opposite to the sheet material transportation basis portion 15*a*. In a so-called standby state that the sheet material feeding apparatus stops transporting the sheet material, the pressure plate 16 stops at a predetermined position in a direction apart from the feeding roller 11, and in this state an interspace sufficient to stack the plural sheet materials is secured between the feeding roller 11 and the pressure plate 16.

The sheet material feeding apparatus of the embodiment is designed to be adapted to a desired sheet material width within a range of a predetermined width. Thus, if the side guide 17 is slid in the direction C of FIG. 1 to be adapted to the sheet material width after the plural sheet materials are stacked at the interspace between the feeding roller 11 and the pressure plate 16 along the sheet material transportation basis portion 15*a*, the movement of the sheaf of the stacked sheet materials in the direction perpendicular to the sheet material transportation direction is regulated, whereby steady transportation can be performed. Although the side guide 17 is slidably fit on the pressure plate 16, the side guide 17 itself is structured to be fixable by engaging with a latch groove made on the pressure plate 16 so as not to move needlessly. Therefore, when the side guide 17 is moved, the engagement between the side guide 17 and the latch groove on the pressure plate 16 is released by operating a lever unit provided on the side guide 17.

The sheet materials set on the sheet material stacking unit are urged downward by gravity, and the lower edge of the sheet material bumps to a sheet material leading edge basis portion 15*b* provided fixedly on the ASF base 15. In the embodiment, in order to decrease a load which is put on the sheet material when this sheet material is being transported, the sheet material leading edge basis portion 15*b* has a rib shape.

Here, a driving mechanism portion of the sheet material feeding apparatus will be explained with reference to FIG. 2. FIG. 2 is the schematic side view showing the sheet material feeding apparatus being viewed from a direction B shown in FIG. 1.

As shown in FIG. 2, an input gear 20, a double gear 21, a feeding shaft gear 22, a control gear 23 and the control cam 14 are disposed on the side of the ASF base 15. The input gear 20 is engaged with a gear on the side of the body of the recording apparatus when the sheet material feeding apparatus is installed in the body of the recording apparatus, whereby the input gear 20 receives the driving force from the gear on the side of the body of the recording apparatus. The double gear 21 is composed of two gear units which are coaxially arranged and respectively have different diameters, and the gear unit having the smaller diameter is engaged with the input gear 20, whereby the driving force transmitted to the input gear 20 is further transmitted to a next-stage gear through the double gear 21.

The feeding shaft gear 22 is fixed to one end of the feeding shaft 10 and also engaged with the gear unit having the larger diameter of the double gear 21, whereby the driving force transmitted from the double gear 21 is further transmitted from the feeding shaft gear 22 to the feeding shaft 10 and a next-stage gear. The control gear 23 is engaged with the feeding shaft gear 22, whereby the driving of the turn-back levers 13 and the separation roller 12 is controlled on the basis of the driving force transmitted from the feeding shaft gear 22. A cam 23*a* which is engaged with the control cam 14 to control a driving operation of the control cam 14 is formed on one side of the control gear 23. One end of an urging spring 25 is fit on an engaging portion formed on the side of the control cam 14, while the other end thereof is fit on an engaging portion formed on the ASF base 15. The urging spring 25 is to urge the control cam 14 into its one rotation direction so as to regulate a relative rotation angle of the control cam 14 with respect to the turn-back lever 13 to a predetermined angle in accordance with a rotative operation of the cam 23*a*. As described above, pressure springs 26 are fit on the holder 27 rotatably supporting the separation roller 12 and on the ASF base 15 respectively, whereby the separation roller 12 is pressed toward the feeding roller 11 by the pressure spring 26.

The driving force which is transmitted from the gear provided on the body of the recording apparatus causes the input gear 20 to rotate in the direction B shown in FIG. 2. Then, the driving force transmitted to the input gear 20 is further transmitted to the feeding shaft gear 22 through the double gear 21 which rotates at rotation speed decelerated lower than that of the input gear 20, whereby the feeding shaft gear 22 is rotated in the direction A of FIG. 2. The driving force transmitted to the feeding shaft gear 22 is further transmitted to the control gear 23. Here, since the feeding shaft gear 22 and the control gear 23 are linked together at a deceleration ratio of 1:1, these gears rotate always with a synchronized angle phase.

Figure 5:
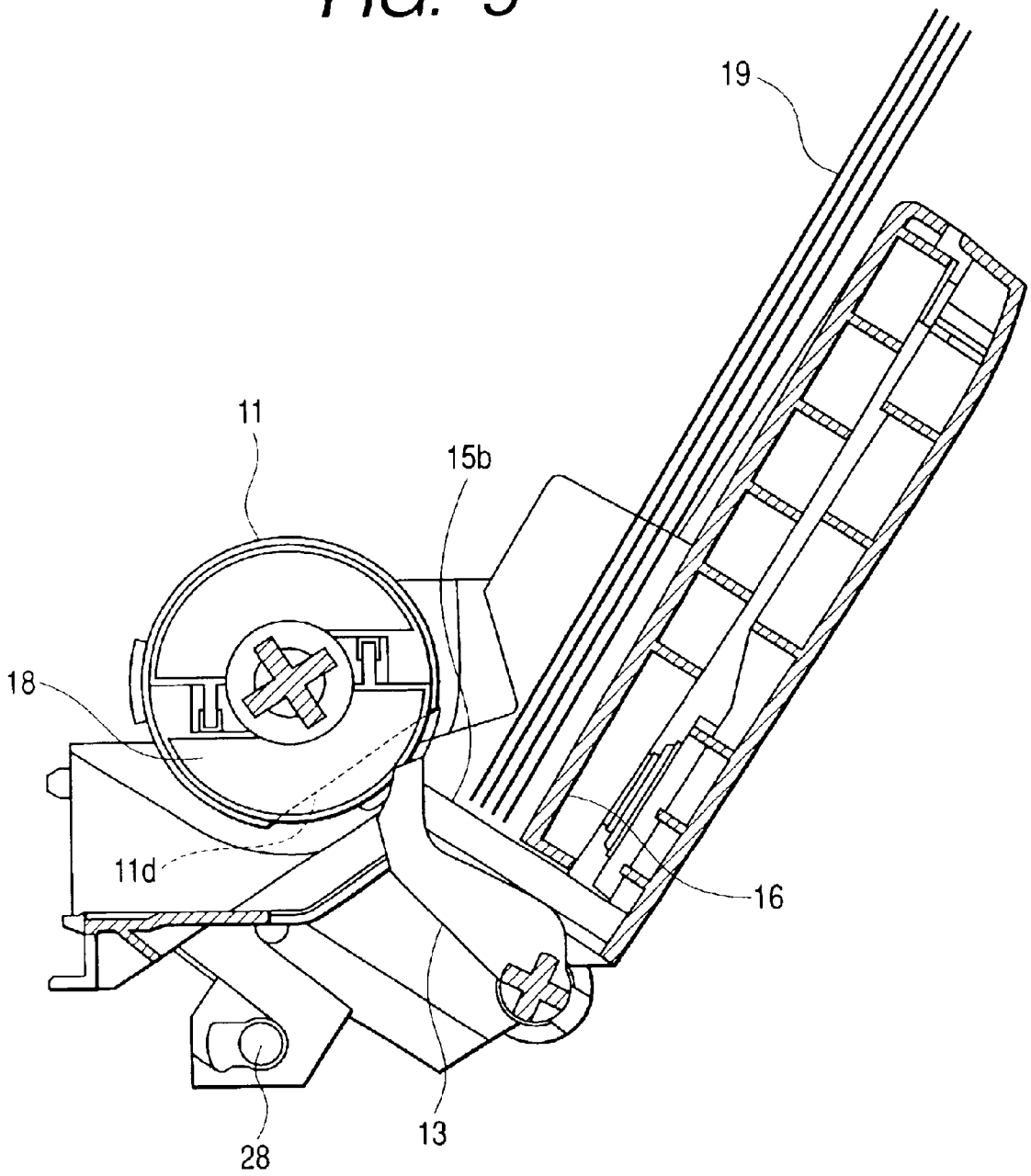
FIG. 5 is a schematic sectional view of the sheet material feeding apparatus showing a standby state of FIG. 4D in association with a sheet material passing route.

On the side of the control cam 14, a cam follower portion 14*b* which projects from this side is formed. Since the cam follower portion 14*b* which is urged by the urging spring 25 always follows the cam 23*a*, the control cam 14 is driven and controlled in synchronism with the feeding shaft 10. Further, a control cam 28 later described in FIG. 5 is driven by a not-shown cam provided on the side opposite to the side of the cam 23*a* of the control gear 23, whereby the position of the separation roller 12 is driven and controlled in synchronism with the feeding shaft 10 in accordance with the operation of the control cam 28. Therefore, a control means which controls an operation to move the separation roller 12 is structured on the basis of the cam provided on the side opposite to the side of the cam 23*a* of the control gear 23 and the control cam 28. Although the separation roller 12 is rotatably held by the holder 27, the holder 27 itself is rotatably supported based on a rotation center, and, as described above, the separation roller 12 is urged toward the feeding roller 11 by the action of the pressure spring 26. Further, the driving of the separation roller 12 is controlled by the above control cam 28 to release the urging to the control cam 14 by the urging spring 25 at later-described necessary timing and thus release the separation roller 12 from the feeding roller 11.

The above-explained structure corresponds to the driving mechanism portion, and next a structure of the feeding/separation unit will be explained.

FIGS. 7 to 10 are side views respectively showing the operation of the sheet material feeding apparatus shown in FIG. 1. In FIGS. 7 to 10, only the peripheral portions of the pressure plate 16, the feeding roller 11 and the separation roller 12 are shown to explain the relation of the pressure plate 16, the feeding roller 11 and the separation roller 12.

The pressure plate 16 includes a rotation spindle 16*b* at its upper end in a use state, whereby the pressure plate 16 rotatably moves on the basis of the rotation spindle 16*b*. Here, it should be noted that the operation of the pressure plate 16 is regulated by springs and cams. That is, the pressure plate 16 is pressed by a not-shown pressure plate spring so as to be rotated, whereby the pressure plate 16 is urged toward the feeding roller 11. A cam 16*a* is provided at the lower end of the pressure plate 16. On the other hand, a cam 22*a* is provided on the surface of the feeding roller 11 of the feeding shaft gear 22 shown in FIG. 2, and the cam 22*a* is shown in FIGS. 7 to 10 respectively. As described later, the cam 22*a* is in contact with the cam 16*a* of the pressure plate 16 when a rotation angle of the feeding roller 11 is within a predetermined range. That is, the feeding roller 11 rotates in the direction A as shown in the order of FIGS. 7, 8, 9 and 10, and the cam 16*a* slips down from the cam 22*a*, whereby the pressure plate 16 is rotated on the basis of the rotation spindle 16*b* by the urging force of the pressure plate spring.

Figure 8:
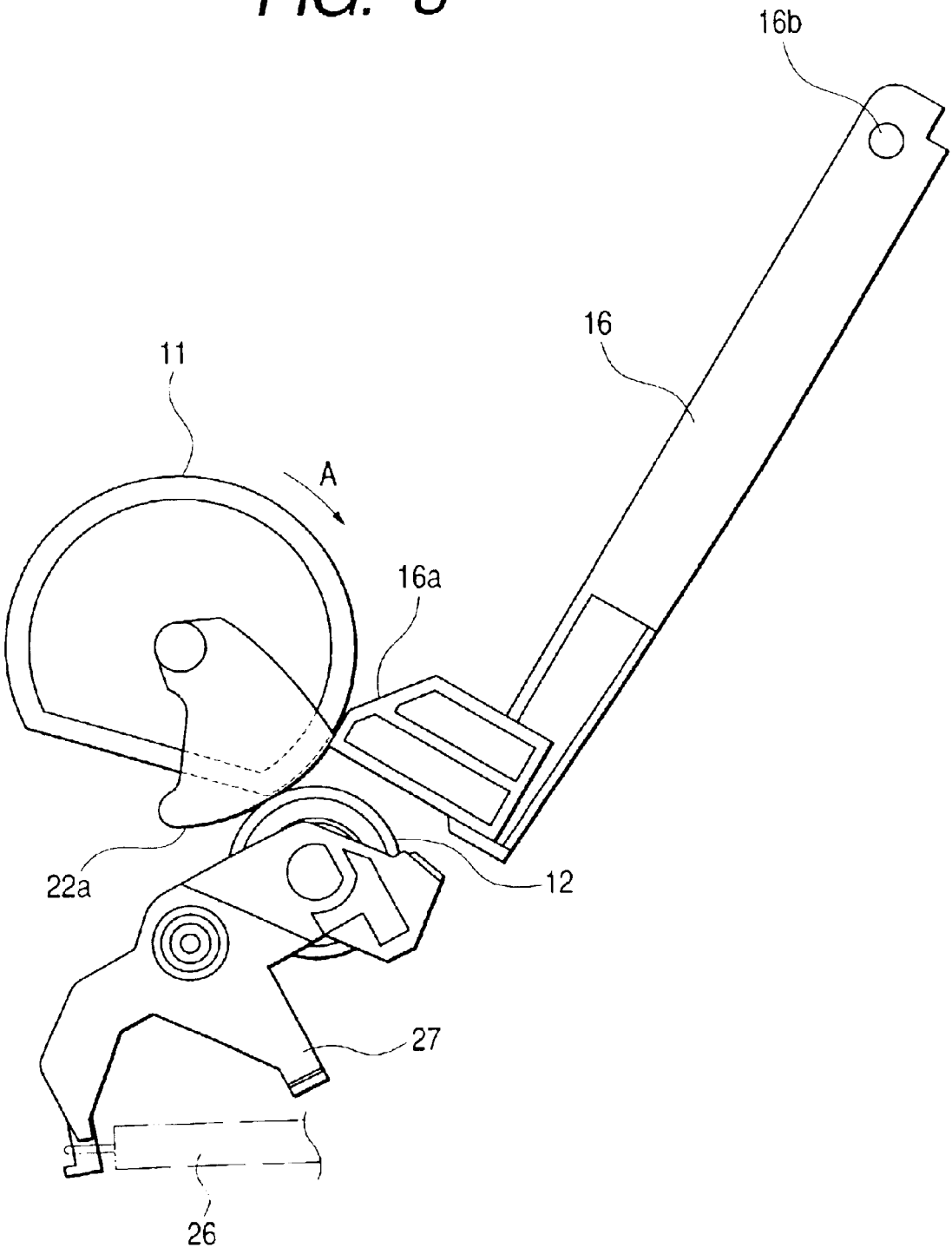
FIG. 8 is a side view showing the operation of the sheet material feeding apparatus.
Figure 9:
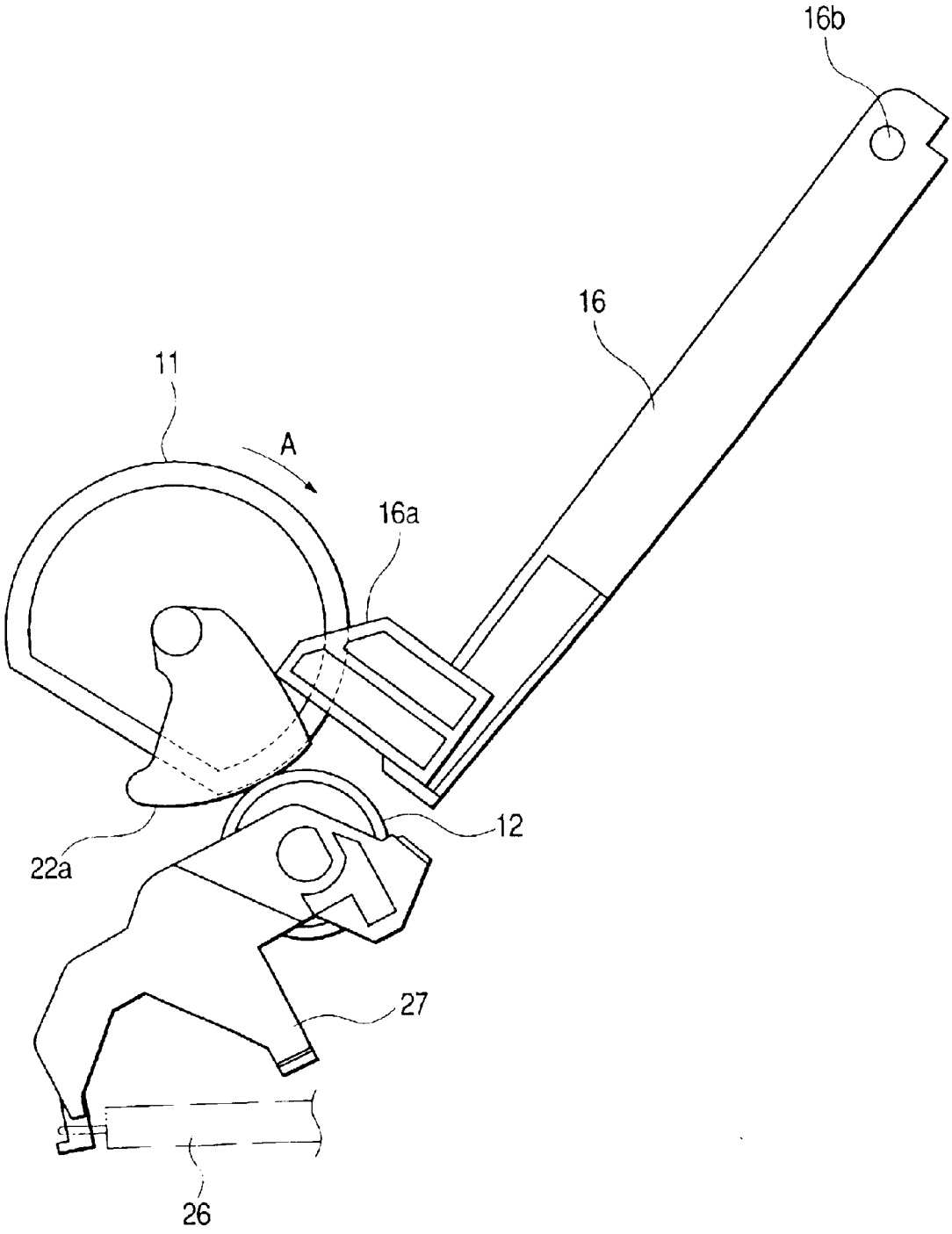
FIG. 9 is a side view showing the operation of the sheet material feeding apparatus.
Figure 10:
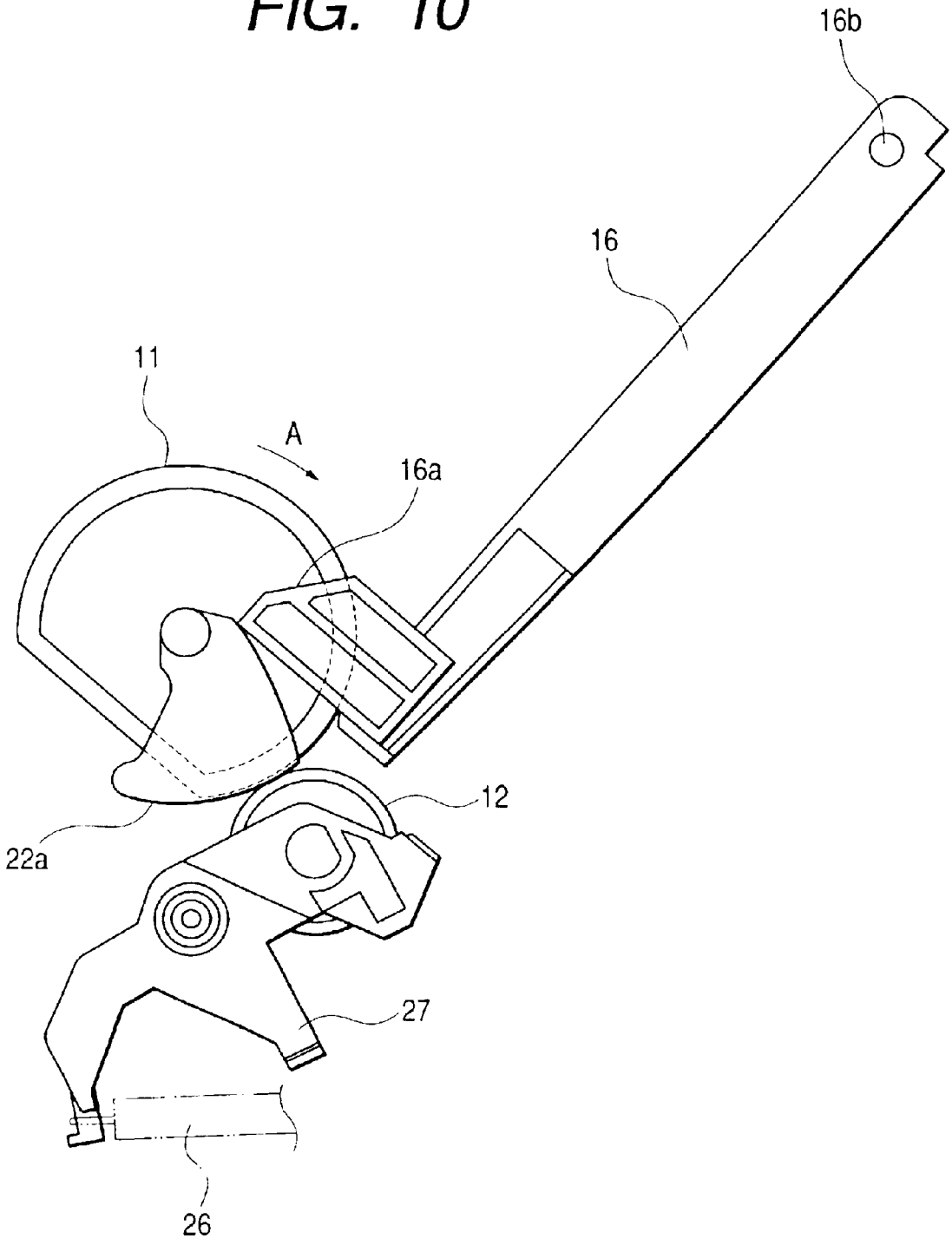
FIG. 10 is a side view showing the operation of the sheet material feeding apparatus.

Thus, when the cam 16*a* slips down from the cam 22*a*, a rotation torque T1 is generated by the pressing force of the cam 16*a*. Here, as shown in FIG. 8, since the separation roller 12 is already in contact with the feeding roller 11 before the cam 16*a* slips down from the cam 22*a* as shown in FIG. 8, the rotation torque T1 is set to be smaller than a braking torque T2 applied to the feeding roller 11 based on the torque of the separation roller 12 (T1<T2). Therefore, even in a structure that driving force from a driving source such as a not-shown motor or the like is transmitted to the feeding roller through a later-described planet gear clutch (FIG. 11) for intermitting the transmission of the driving force so as to be able to transmit the driving force from the driving source also to a unit (e.g., a not-shown recovery-system unit provided in the recording apparatus) other than the sheet material feeding apparatus, it is possible, by the braking force applied from the separation roller 12, to prevent that the feeding roller 11 antecedently rotates by the rotation urging force applied to the pressure plate 16 by the pressure plate spring.

Figure 11:
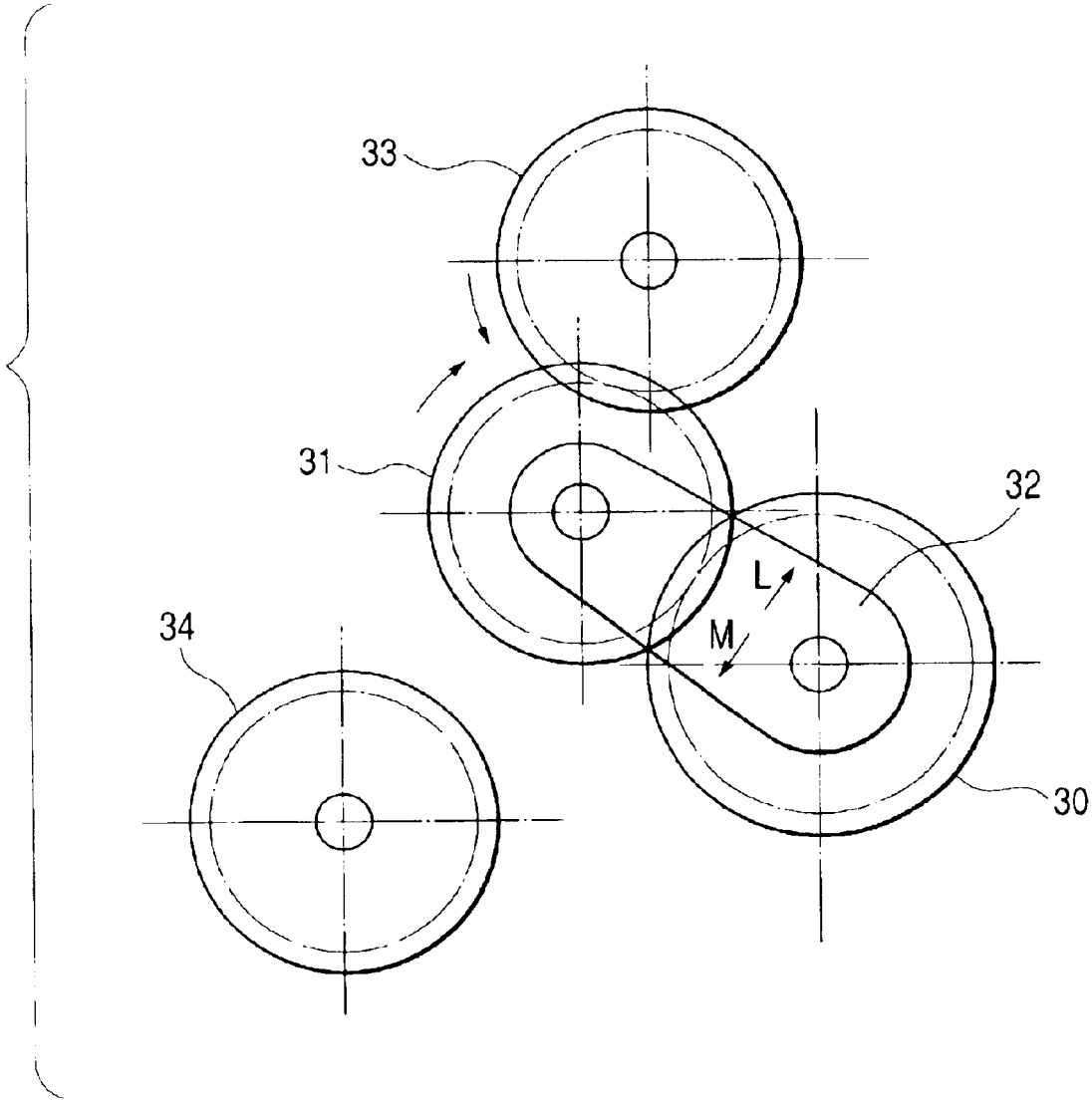
FIG. 11 is a schematic side view showing a structure of a planet gear clutch used in the sheet material feeding apparatus.

FIG. 11 is the schematic side view showing the planet gear clutch to be used in the sheet material feeding apparatus according to the embodiment. In the planet gear clutch of FIG. 11, a gear holder 32 is rotatably fit on the rotation center shaft of a sun gear 30 which is driven by a not-shown motor, and a planet gear 31 is rotatably fit on the end of the gear holder 32 so that the planet gear 31 engages with the sun gear 30. Further, the planet gear 31 is structured so that, according to the rotation direction of the gear holder 32, the planet gear 31 can engage with an ASF first gear 33 (in case of rotating the gear holder 32 in a direction L) or a recovery-system first gear 34 (in case of rotating the gear holder 32 in a direction M).

The ASF first gear 33 transmits the driving force to the ASF unit, i.e., the sheet material feeding apparatus of the embodiment, through a not-shown gear string, and the recovery-system first gear 34 transmits the driving force to a not-shown recovery-system unit. For example, if it intends to rotate the feeding roller 11 at speed higher than the driving speed of the motor, the ASF first gear 33 is rotated clockwise in FIG. 11, whereby the gear 33 is released from the engagement with the planet gear 31. As a result, the feeding roller 11 is rotated at the speed higher than the driving speed of the motor.

On one hand, as previously described, the movement of the pressure plate 16 toward the direction apart from the feeding roller 11 is performed by the rotation of the pressure plate 16 which occurs when the cam 16*a* is pressed by the cam 22*a* according to the rotation of the feeding roller 11.

The operation to urge/release the pressure plate 16 into/from the feeding roller 11 is performed at later-described predetermined timing, whereby the feeding operation in the sheet material feeding apparatus is performed.

Next, the structure of the feeding/separation unit of the sheet material feeding apparatus will be further explained.

By the operation that the pressure plate 16 is urged to and released from the feeding roller 11 at the predetermined timing as described above, the sheaf of the sheet materials stacked on the pressure plate 16 is pressed against the feeding roller 11. At the same time, since the feeding roller 11 is driven to rotate, the uppermost sheet material of the sheaf of the sheet materials stacked on the pressure plate 16 comes into contact with the feeding roller 11, whereby the uppermost sheet material is transported by frictional force between this sheet material and the feeding roller 11. Thus, since the feeding roller 11 transports the sheet material by the frictional force, rubber such as EPDM (ethylene-propylene-diene copolymer) or the like having a high friction coefficient, urethane foam and the like can be suitably used as the material of the feeding roller 11.

Incidentally, as described above, the mechanism to release the pressure plate 16 from the feeding roller 11 is structured by using the cam 22*a* provided coaxially with the feeding shaft gear 22. Equally, on the feeding shaft 10, the same cam is provided on the side opposite to the side of the feeding shaft gear 22 shown in FIG. 2, whereby the pressure plate 16 is rotated and moved uniformly by simultaneously pressing both the edges of the pressure plate 16 with these cams.

Next, the structure of the feeding/separation unit will be further explained successively.

The uppermost sheet material of the sheaf of the sheet materials stacked on the pressure plate 16 is fed and transported by the feeding roller 11. At this time, basically, the frictional force between the feeding roller 11 and the uppermost sheet material is often larger than frictional force between the uppermost sheet material and the sheet material immediately below the uppermost sheet material, only the uppermost sheet material is often transported. However, for example, in a case where a burr which is formed at the edge of the sheet material when this sheet material is cut out affects the operation, in a case where the sheet materials cleave to each other due to static electricity, or in a case where a sheet material of which the surface friction coefficient is extremely high is used, the plural sheet materials might be drawn out at a time from the pressure plate 16 by the feeding roller 11. In this case, according to the embodiment, only the uppermost sheet is separated from the sheaf of the sheet materials stacked on the pressure plate 16 in the following way.

In the embodiment, the separation roller 12 is pressed against the feeding roller 11 so that the separation roller 12 comes into contact with the surface of the feeding roller 11 on a downstream side along the transporting direction where the sheet material first comes into contact with the feeding roller 11. Here, the separation roller 12 itself is merely held rotatably by the holder 27, that is, the holder 27 does not actively drive the separation roller 12 to rotate. However, the spindle of the separation roller 12 is fixed, and a coil spring which is formed by metal, plastics or the like is held between the fixed spindle and the separation roller 12. Thus, when the separation roller 12 is rotated up to a predetermined angle and thus the coil spring coils around the fixed spindle, the coil spring and the fixed spindle relatively slip, whereby predetermined torque is maintained. The surface of the separation roller 12 is made by rubber, urethane foam or the like so that the separation roller 12 has the friction coefficient substantially the same as that of the feeding roller 11. By such a structure, when the sheet material is not set between the feeding roller 11 and the separation roller 12, the separation roller 12 rotates according to the rotative operation of the feeding roller 11, that is, the separation roller 12 follows the feeding roller 11.

In a case where one sheet material is set between the feeding roller 11 and the separation roller 12, since the frictional force between the feeding roller 11 and the sheet material is larger than the frictional force between the sheet material and the separation roller 12 following with the predetermined torque, the sheet material is transported as it causes the separation roller 12 to follow. However, in a case where two sheet materials are set between the feeding roller 11 and the separation roller 12, since the frictional force between the feeding roller 11 and the sheet material set on the side of the feeding roller 11 is larger than the frictional force between these two sheet materials and the frictional force between the separation roller 12 and the sheet material set on the side of the separation roller 12 is larger than the frictional force between these two sheet materials, a slip occurs between these two sheet materials. As a result, only the sheet material on the side of the feeding roller 11 is transported, while the sheet material on the side of the separation roller 12 stops moving when the separation roller 12 stops rotating, that is, the sheet material on the side of the separation roller 12 is not transported. The above is the outline of the separation unit for separating the overlapping sheet materials from each other by using the separation roller 12.

Next, a structure of the multifeeding (or overlap feeding) prevention unit will be explained.

As described above, if the two sheet materials or so are set to the nipped portion between the feeding roller 11 and the separation roller 12, these sheet materials can be separated from each other. However, it is assumed that the further sheet materials are set, or it is assumed that the two sheet materials are set, only the sheet material on the side of the feeding roller 11 is transported, and thereafter the next sheet material is successively fed with the previous sheet material remaining in the vicinity of the nipped portion. In such a case, a phenomenon so-called multifeeding (or overlap feeding) that the plural sheet materials are transported at the same time may occur. To prevent this phenomenon, the multifeeding prevention unit is provided in the sheet material feeding apparatus according to the embodiment. Here, it should be noted that the multifeeding prevention unit is composed of the control cam 14, the turn-back levers 13 and the like of the above driving mechanism portion.

Figure 3:
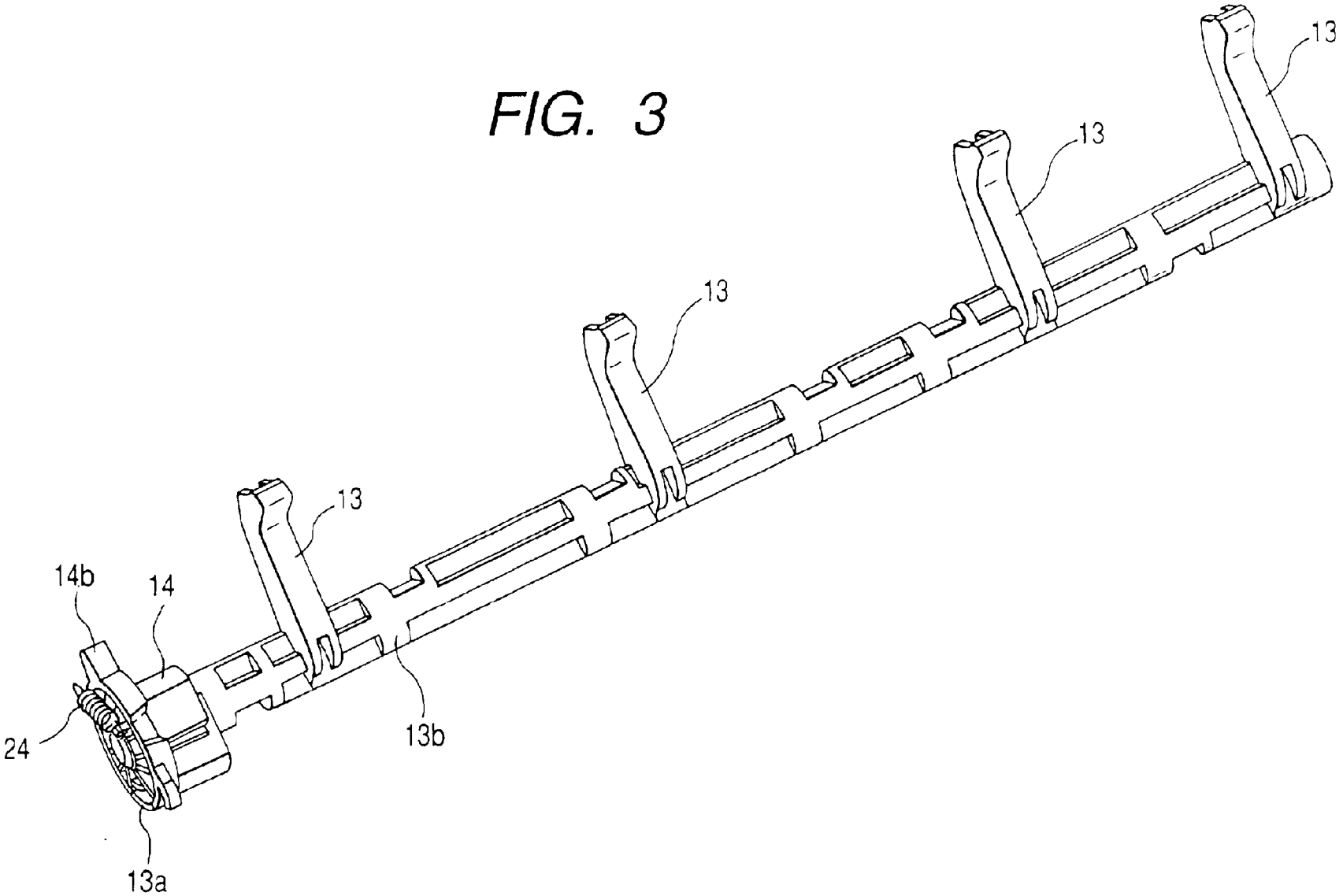
FIG. 3 is a schematic perspective view showing relation between turn-back levers and a control cam.

FIG. 3 is a schematic perspective view showing the relation between the turn-back levers 13 and the control cam 14.

The sheet material feeding apparatus according to the embodiment is provided with the four turn-back levers 13, and, as shown in FIG. 3, these levers are mutually provided on a cylindrical rotative shaft 13*b* at regular intervals, and the levers 13 and the shaft 13*b* are integrally manufactured. Further, a hole into which one end of the shaft 13*b* is rotatably fit is formed on the control cam 14, and thus the control cam 14 is fit on the one end of the rotative shaft 13*b* coaxially by inserting the one end of this shaft into the hole on the control cam 14.

Further, on the control cam 14, a reentrant (recessed) notch into which a projection 13*a* extending from one end surface of the rotative shaft 13*b* is inserted as shown in FIGS. 2 and 3 is formed like a circular arc, and thus a relative rotation angle between the rotative shaft 13*b* and the control cam 14 is regulated by engaging the projection 13*a* with the reentrant notch. Within the range where the relative rotations of the rotative shaft 13*b* and the control cam 14 are possible, a spring 24 is provided over the rotative shaft 13*b* and the control cam 14 to put these relative rotations aside to one direction. By such a structure, when the control cam 14 is rotated in the direction C of FIG. 2, the turn-back levers 13 rotate in synchronism with the control cam 14. However, when the control cam 14 is fixed and the turn-back levers 13 are rotated in the direction opposite to the direction C of FIG. 2, the turn-back levers 13 can rotate and move independently of the control cam 14 by a predetermined angle range.

As explained for the driving mechanism portion mentioned above, the turn-back levers 13 operate in synchronism with the rotation of the control gear 23. Further, the basic operations of the turn-back levers 13 and the control gear 23 will be explained hereinafter.

FIGS. 4A, 4B, 4C and 4D are side views showing the portion of the sheet material feeding apparatus which includes the control gear 23, the control cam 14 and the like, in order to explain the operation of the turn-back levers 13. In each of FIGS. 4A to 4D, only the structural components necessary for the explanation are extracted from FIG. 2 and shown.

Basically, each of the turn-back levers 13 can take three kinds of positions.

Figure 4A:
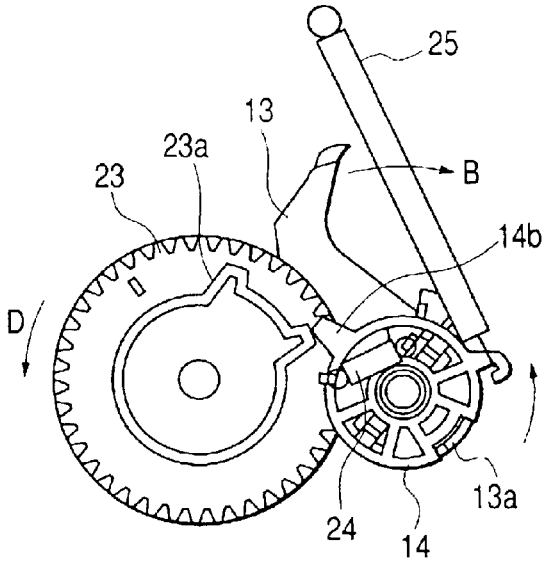
FIGS. 4A, 4B, 4C and 4D are side views showing a portion of the sheet material feeding apparatus including a control gear and the control cam, in order to explain an operation of the turn-back levers.

FIG. 4A shows the state immediately after the feeding operation started. That is, immediately after the feeding operation started, since there is a possibility that the sheet material is newly stacked while the feeding is being on standby, an operation to return the leading edge of the newly stacked sheet material to the predetermined sheet material leading edge basis portion 15*b* is performed. The position of the turn-back lever 13 is the position which is most moved in the direction B of FIG. 4A. If the turn-back lever 13 reaches this position, the leading edge of the precedent sheet material is completely returned to the predetermined sheet material leading edge basis portion 15*b*.

Figure 4B:
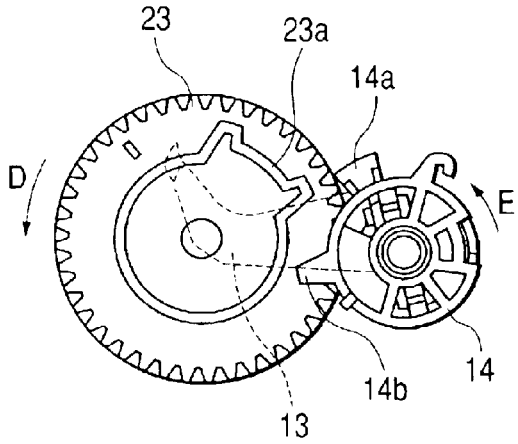

Next, if the control gear 23 is rotated in a direction D of FIG. 4A and thus the cam follower portion 14*b* of the control cam 14 is released from the cam 23*a* of the control gear 23, the turn-back lever 13 is rotated in a direction E of FIG. 4B by the urging force of the pressing spring 25.

FIG. 4B shows the state that the turn-back lever 13 is most rotated and moved in the direction E. At this time, a projection 14*a* projected from the side surface of the control cam 14 comes into contact with a flange portion provided on the surface opposite to the side of the cam 23*a* of the control gear 23 and thus stops moving, whereby the turn-back lever 13 is set to the predetermined position.

Figure 4C:
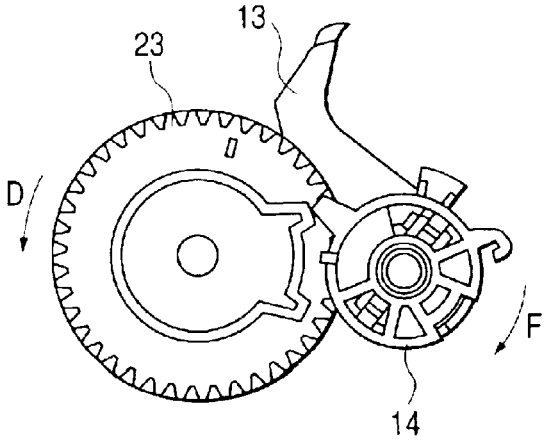

FIG. 4C shows the state that the control gear 23 is further rotated from the state shown in FIG. 4B in the direction D and the turn-back lever 13 is thus returned to the position shown in FIG. 4A during the feeding operation. In this state, the position itself of the turn-back lever 13 is substantially the same as the position shown in FIG. 4A.

Figure 4D:
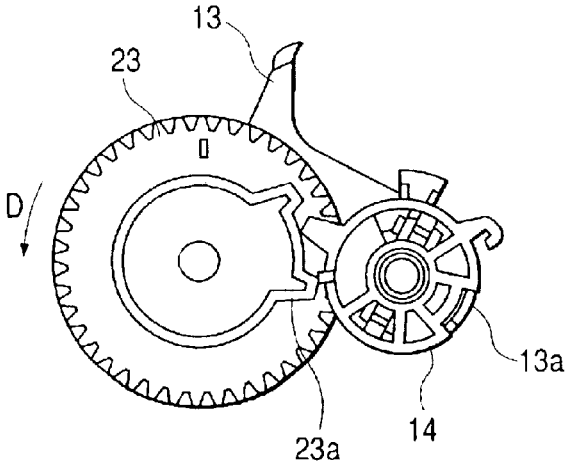

FIG. 4D shows the position of the turn-back lever 13 when the feeding operation of the sheet material feeding apparatus is on standby. When the feeding operation is on standby, the end of the turn-back lever 13 is inserted into the sheet material passing route as described above, whereby it is prevented that the leading edge of the sheet material carelessly enters the interior of the sheet material feeding apparatus in case of setting the sheet material to the sheet material feeding apparatus.

FIG. 5 is the schematic sectional view of the sheet material feeding apparatus showing the standby state of FIG. 4D in association with the sheet material passing route. It should be noted that FIG. 5 shows the section along the alternate long and short dashed line D of FIG. 1 which is viewed from the direction B.

As shown in FIG. 5, a D-cut surface 11*d* extending in the direction parallel with the shaft of the feeding roller 11 is formed as a plane portion on the periphery of the feeding roller 11 so that the sectional shape of the feeding roller 11 becomes "D". Therefore, after the leading edge of the sheet material fed by the one-time rotation of the feeding roller 11 was grasped on the side of the body of the recording apparatus, the D-cut surface 11*d* is opposed to the separation roller 12, whereby an interspace is formed between the feeding roller 11 and the separation roller 12, and the latter half of the sheet material passes this interspace. In such a structure, since the sheet material passing route is doglegged as a whole, the sheet material starts coiling around the feeding roller 11 due to rigidity of the sheet material. Thus, if nothing is performed, the feeding roller 11 of which the surface friction coefficient is high comes into contact with the sheet material, whereby a serious friction load is given to the sheet material. In order to prevent this, the feeding roller 18 of which the friction coefficient with the sheet material is low and which easily rotates according to the sheet material is provided in the vicinity of the feeding roller 11 on the feeding shaft 10.

Next, mutual associated operations of the structural parts in the mechanism of the sheet material feeding apparatus according to the embodiment will be explained with reference to a timing chart.

Figure 6:
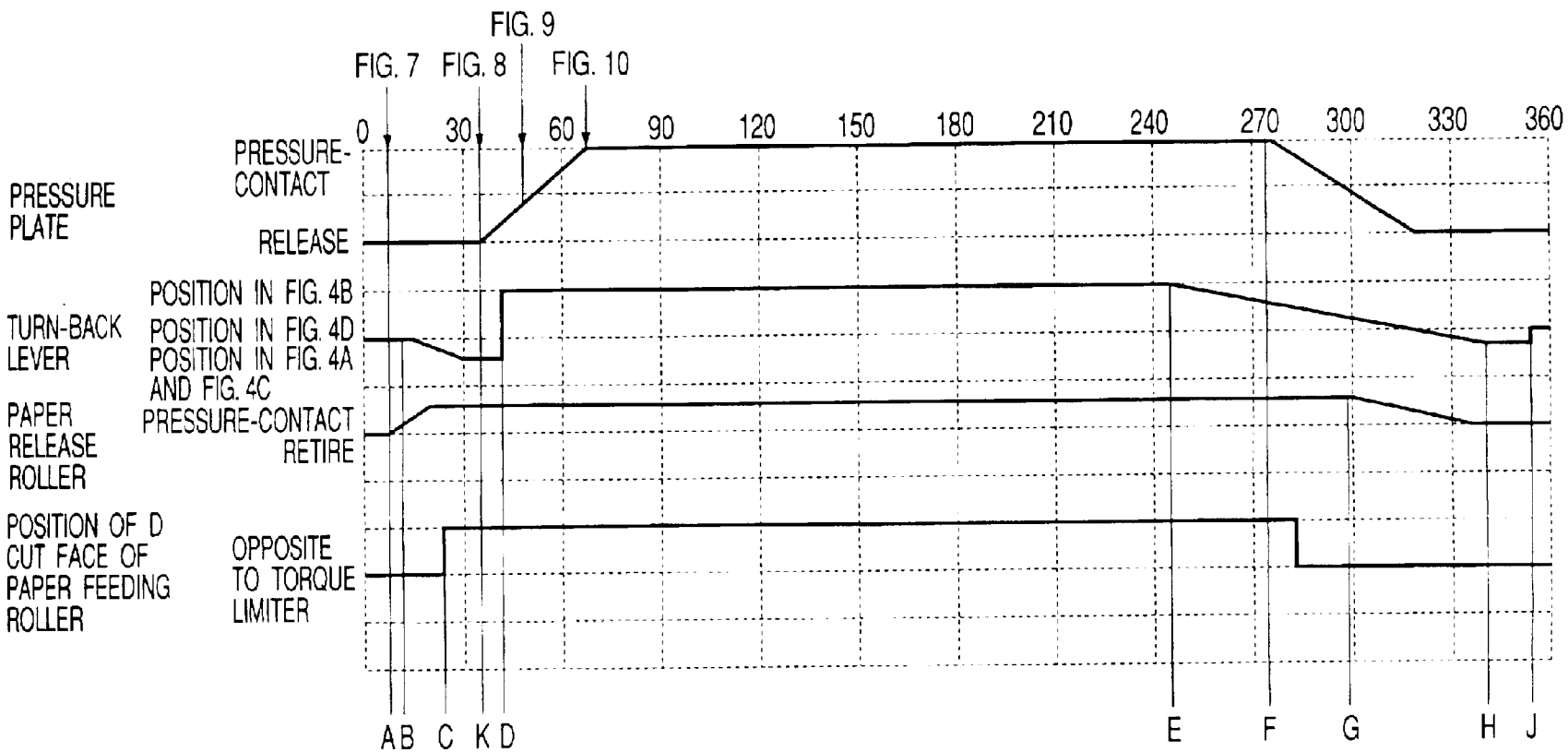
FIG. 6 is a timing chart showing an operation of the sheet material feeding apparatus according to the present invention.
Figure 7:
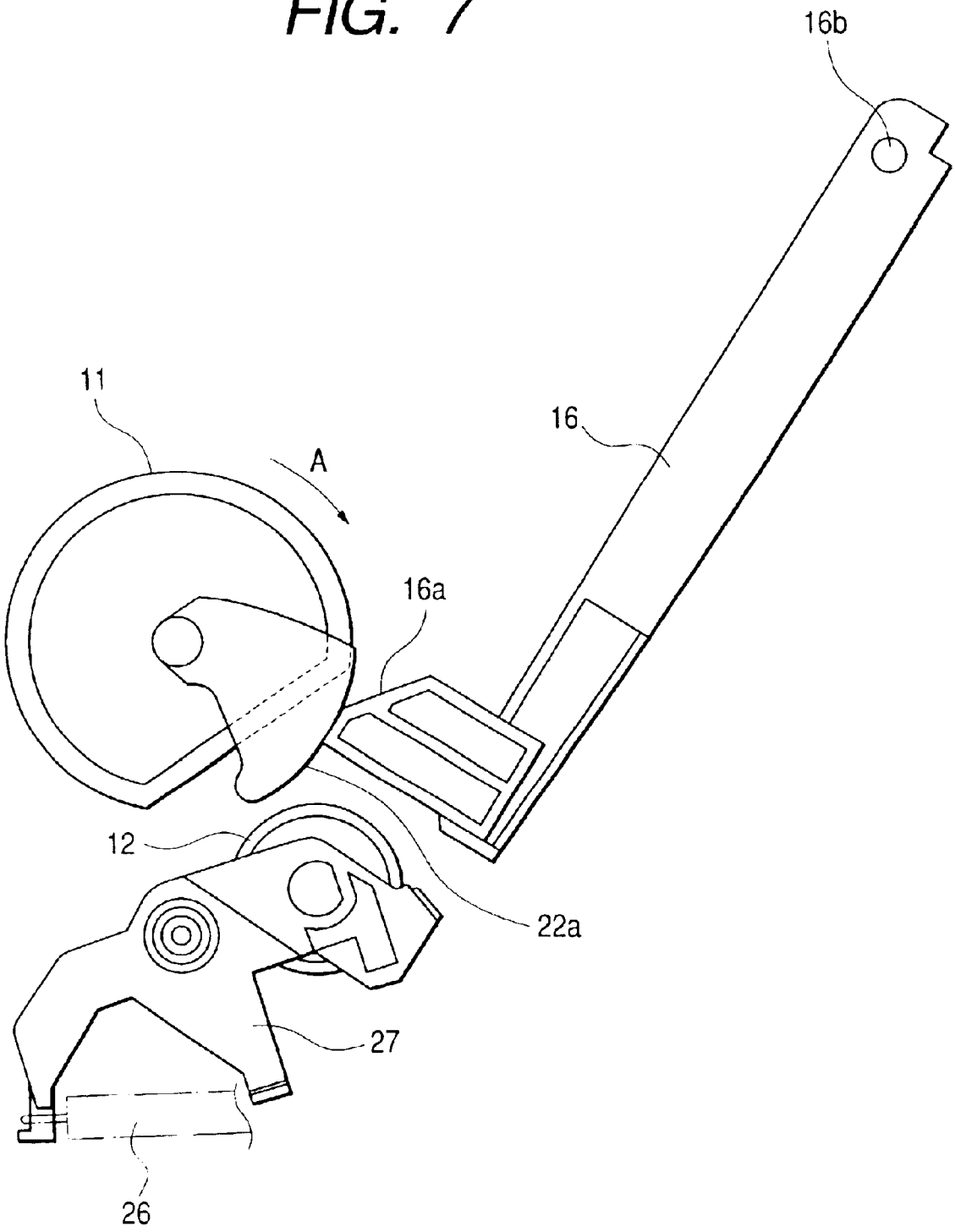
FIG. 7 is a side view showing the operation of the sheet material feeding apparatus.

FIG. 6 is the timing chart showing the operation of the sheet material feeding apparatus according to the embodiment. Concretely, FIG. 6 shows the position of the pressure plate 16, the position of the turn-back lever 13, the position of the separation roller 12, and the rotation angle of the feeding roller 11.

In FIG. 6, the rotation angle 0° of the feeding roller 11 indicates the standby state shown in FIG. 5, that is, a series of operations starts from this standby state of FIG. 5. At this time, the pressure plate 16 is held at the position released (apart) from the feeding roller 11, i.e., a released position, and the turn-back lever 13 is at the position shown in FIG. 4D. Further, the separation roller 12 is at the position retracted from the feeding roller 11, i.e., a retracted position, and the D-cut surface lid of the feeding roller 11 is opposite to the separation roller 12.

Next, if the feeding roller 11 is rotated up to an angle A, the control cam 28 is first operated, and the separation roller 12 starts moving from the retracted position to the pressure-contact position. At this time, the feeding roller 11, the separation roller 12 and the pressure plate 16 are in the state shown in FIG. 7.

Next, if the feeding roller 11 is rotated up to an angle B, the turn-back lever 13 is moved to the position shown in FIG. 4A by the control cam 14 to start returning the leading edges of the sheet materials with possibility of becoming irregular on the sheet material feeding apparatus during the standby state, up to a sheet material leading edge basis portion 15*b*.

Next, if the rotation angle of the feeding roller 11 comes to be in the vicinity of an angle C, the curved surface portion of the feeding roller 11 is rotated to the position opposite to the separation roller 12, and at the same time the separation roller 12 moved toward the pressure-contact direction on the side of the feeding roller 11 completes its movement, whereby the curved surface portion of the feeding roller 11 comes into pressure-contact with the separation roller 12. At this time, since the separation roller 12 moves according to the rotative movement of the feeding roller 11, the coil spring of the separation roller 12 is charged up to a predetermined torque.

Next, if the rotation angle of the feeding roller 11 becomes an angle K, the fixed pressure plate 16 is released, and the pressure plate 16 and the sheet materials set on this plate start moving in the direction toward the feeding roller 11. Here, the feeding roller 11, the separation roller 12 and the pressure plate 16 are in the state shown in FIG. 8. At this time, since the separation roller 12 is already in contact with the feeding roller 11 as described above, even if driving force from a not-shown motor is transmitted to the feeding roller 11 through the planet gear clutch so that the driving force can be transmitted also to a unit (e.g., a not-shown recovery-system unit) other than the sheet material feeding apparatus, it is possible, by the braking force applied from the separation roller 12, to prevent that the feeding roller 11 antecedently rotates by the rotative pressing force applied to the pressure plate 16 by the pressure plate spring. That is, in the planet gear clutch shown in FIG. 11, even if the rotative urging force is applied from the pressure plate 16 to the feeding shaft 10 through the cam 22*a* in the state that the planet gear 31 is engaging with the ASF first gear 33, the ASF first gear 33 is released from the engagement with the planet gear 31, whereby the feeding roller 11 does not antecedently rotate.

Next, if the rotation angle of the feeding roller 11 becomes an angle D, the turn-back lever 13 moves to the position of FIG. 4B in one breath and thus completely retracts from the sheet material passing route. After the turn-back lever 13 retracted, through the states shown in FIGS. 9 and 10, it causes an uppermost sheet material 19 of a sheaf of the sheet materials stacked on the pressure plate 16 as shown in FIG. 5 to come into pressure-contact with the feeding roller 11, and then the transportation of the sheet material is started as described above.

Here, the sheet materials are continuously transported one by one for a while, and, if the plural sheet materials are transported in the state that they overlap each other as above, the overlapping sheet materials are separated by the separation unit. Thus, the sheet materials are transported toward the body of the recording apparatus (in the direction A shown in FIG. 1). Then, the leading edge of the transported sheet material is grasped on the side of the recording apparatus, this sheet material is transported by the cooperation of the body of the recording apparatus and the feeding roller 11, and then the multifeeding prevention operation starts.

Next, if the rotation angle of the feeding roller 11 comes to be in the vicinity of an angle E, the turn-back lever 13 starts rotating in the direction F of FIG. 4C.

Next, if the rotation angle of the feeding roller 11 comes to be in the vicinity of an angle F, the releasing operation of the pressure plate 16 is started. That is, if the pressure plate 16 is moved in the direction released (apart) from the feeding roller 11, the sheet material on the pressure plate 16 is released from the pressure-contact with the feeding roller 11, whereby the transportation force of the sheet material decreases. Further, immediately after this, the D-cut surface lid of the feeding roller 11 becomes opposite to the pressure-plate portion on which the pressure plate 16 has been fit. However, since the separation roller 12 is still in pressure-contact with the feeding roller 11, the sheet materials are continuously being transported.

Next, if the rotation angle of the feeding roller 11 comes to be in the vicinity of an angle G, the separation roller 12 starts releasing from the feeding roller 11 by the operation of the control cam 28. If the separation roller 12 is made apart from the feeding roller 11, the pressure-contact force of the feeding roller 11 to the sheet material vanishes, whereby the force to hold the sheet materials also vanishes on the side of the sheet material feeding apparatus, while the sheet materials are still held on the side of the body of the recording apparatus. Thus, the turn-back lever 13 starts entering the sheet material passing route just at timing that the sheet holding force vanishes. Here, if the leading edge of the next sheet material remains in the vicinity of the portion nipped between the feeding roller 11 and the separation roller 12, this leading edge of the sheet material is scraped (or scratched) off and then returned by the end of the turn-back lever 13.

Next, if the rotation angle of the feeding roller 11 comes to be in the vicinity of an angle H, the turn-back lever 13 is completely returned to the position shown in FIG. 4C, and the leading edges of all the sheet materials other than the sheet materials just being transported are transported oppositely to the sheet material leading edge basis portion 15*b*.

Next, if the rotation angle of the feeding roller 11 comes to be in the vicinity of an angle J, the rotation angle of the control cam 14 is returned to the angle shown in FIG. 4D, and the turn-back lever 13 is returned to the standby position shown in FIG. 4D.

By the above, the control of the sheet material feeding apparatus synchronous with the one-time rotation of the feeding roller 11 ends.

As explained above, according to the embodiment, in the sheet material feeding apparatus which separates the sheet materials one by one from the sheaf of the plural sheet materials stacked on the pressure plate 16 and then feeds the separated sheet materials by using the feeding roller 11 and the separation roller 12, it causes the separation roller 12 to come into contact with the feeding roller 11 when the pressure plate 16 is moved by the cam 22*a* on the rotating shaft of the feeding roller 11. Thus, even if the force is applied from the pressure plate 16 to the cam 22*a* and thus it is intended to rotate the feeding roller 11 by the applied force, it is possible by the braking force applied from the separation roller 12 to prevent that the feeding roller 11 antecedently rotates. That is, even if the driving force from the driving source is transmitted to the feeding roller 11 through the clutch means for intermitting the transmission of the driving force so as to rotate the feeding roller 11, when the force is applied to the cam 22*a* on the feeding shaft 10 to move the pressure plate 16, the transmission of the driving force of the clutch means is not released by the rotation force of the feeding roller 11 by the cam 22*a*, whereby the antecedent rotation phenomenon of the feeding roller 11 does not occur. By such a structure, even if the feeding roller 11 is driven by the driving source for driving the apparatus other than the sheet material feeding apparatus, it is possible to control the speed at which the sheet material on the stacking unit comes into contact with the feeding roller 11 and thus reduce the crush sound made when the sheet material comes into contact with the roller 11. As a result, it becomes unnecessary to provide a driving source dedicated for the sheet material feeding apparatus in the sheet material feeding apparatus, the recording apparatus in which the sheet material feeding apparatus is installed, and the like, whereby it is possible to achieve the feeding mechanism by which the multifeeding of the sheet materials is prevented without making the apparatus complicated, enlarging the apparatus size, and increasing the cost.

In the separation unit of the sheet material feeding apparatus of the embodiment, the friction separation system using the separation roller is used to separate the sheet materials, however, the present invention is not limited to this. That is, it is needless to say that various kinds of separation systems such as a friction separation system using a friction pad and the like are applicable to the separation unit.

Further, in the embodiment, when the driving force applied from the motor is transmitted to the feeding roller 11 through the driving force transmission mechanism, the planet gear clutch is used to transmit the driving force also to the unit other than the sheet material feeding apparatus in the middle of this driving force transmission mechanism, however, the present invention is not limited to this. That is, it is needless to say that a spring clutch made by a spring and the like are applicable to the driving force transmission mechanism.

In the above embodiment, the present invention is applied to the recording apparatus of serial type which moves the recording head in the main scanning direction. However, the present invention is applicable also to a recording apparatus of full-line type which records an image by a recording head extending to whole area along the recording sheet width direction as continuously transporting recording sheets.

Further, the above embodiment is explained with respect to the example that the recording head to which a so-called BJ (bubble-jet) system of various kinds of ink-jet systems is applied is used. However, the present invention is applicable not only to such a recording head recording system but also to the various recording systems. For example, as the recording head recording system, a piezoelectric system may be used as well as the BJ system.

As explained above, according to the embodiment, in the sheet material feeding apparatus which separates the sheet materials one by one from the sheaf of the plural sheet materials stacked on the stacking unit and then transports the separated sheet materials by using the feeding roller and the friction separation means, it causes the friction separation means to come into contact with the feeding roller when the pressing member to press and cause the sheet material on the stacking unit to come into contact with the feeding roller is moved by the cam member on the rotating shaft of the feeding roller. Thus, even if the driving force is applied from the driving source to the feeding roller through the clutch means, the phenomenon that the feeding roller antecedently rotates can be prevented by the braking force applied from the friction separation means, whereby it becomes unnecessary to provide the driving source dedicated for the sheet material feeding apparatus. Therefore, in the sheet material feeding apparatus and the recording apparatus in which this sheet material feeding apparatus is installed, it is possible to provide the sheet material feeding apparatus by which the multifeeding of the sheet materials can be easily prevented without making the apparatus complicated, enlarging the apparatus size, and increasing the cost.

What is claimed is:

1. A sheet material feeding apparatus comprising:

sheet material stacking means for stacking sheet materials, wherein said sheet material stacking means comprises a pressure plate, and the sheet materials are stacked on the pressure plate;

a feeding roller for feeding the sheet materials stacked on said sheet material stacking means;

a separation roller, rotating according to said feeding roller, for separating the sheet material;

a separation roller holder for rotatably holding said separation roller, said separation roller holder rotating to cause said separation roller to move to a position being in contact with said feeding roller and to a position being released from said feeding roller;

means for rotating said separation roller holder to cause said separation roller to move to a position being in contact with said feeding roller and to a position being released from said feeding roller;

urging means for urging the pressure plate to said feeding roller to cause the sheet materials stacked on the pressure plate to come into contact with said feeding roller; and a cam provided on a shaft of said feeding roller, being engaged with a cam follower portion of the pressure plate to push down the pressure plate, wherein, after said separation roller comes into contact with said feeding roller, it causes the sheet materials stacked on said sheet material stacking means to come into contact with said feeding roller.

2. An apparatus according to claim 1, further comprising turn-back means for returning the sheet materials other than the sheet materials separated by said separation roller to said sheet material stacking means.

3. An apparatus according to claim 1, wherein said separation roller is provided with a torque limiter.

4. An apparatus according to claim 1, wherein said separation roller is provided with urging means for causing said separation roller to come into pressure-contact with said feeding roller.

5. An apparatus according to claim 1, wherein said separation roller comes into contact with said feeding roller on a downstream side of a position where said feeding roller comes into contact with said sheet material stacking means.

6. An apparatus according to claim 1, wherein a driving force from a driving source is transmitted to said feeding roller through clutch means for intermitting transmission of the driving force.

7. An apparatus according to claim 6, wherein said clutch means includes a planet gear clutch.

8. An apparatus according to claim 6, wherein said clutch means includes a spring clutch composed by using a spring.

9. A recording apparatus which performs recording on a sheet material by using a recording head, comprising:

a head mounting unit for mounting the recording head;

sheet material stacking means for stacking sheet materials, wherein said sheet material stacking means comprises a pressure plate, and the sheet materials are stacked on the pressure plate;

a feeding roller for feeding the sheet materials stacked on said sheet material stacking means;

a separation roller, rotating according to said feeding roller, for separating the sheet material;

a separation roller holder for rotatably holding said separation roller, said separation roller holder rotating to cause said separation roller to move to a position being in contact with said feeding roller and to a position being released from said feeding roller;

means for rotating said separation roller holder to cause said separation roller to move to a position being in contact with said feeding roller and to a position being released from said feeding roller;

urging means for urging the pressure plate to said feeding roller to cause the sheet materials stacked on the pressure plate to come into contact with said feeding roller; and a cam provided on a shaft of said feeding roller, being engaged with a cam follower portion of the pressure plate to push down the pressure plate, wherein, after said separation roller comes into contact with said feeding roller, it causes the sheet materials stacked on said sheet material stacking means to come into contact with said feeding roller.

10. An apparatus according to claim 9, further comprising turn-back means for returning the sheet materials other than the sheet materials separated by said separation roller to said sheet material stacking means.

11. An apparatus according to claim 9, wherein said separation roller is provided with a torque limiter.

12. An apparatus according to claim 9, wherein said separation roller is provided with urging means for causing said separation roller to come into pressure-contact with said feeding roller.

13. An apparatus according to claim 9, wherein said separation roller comes into contact with said feeding roller on a downstream side of a position where said feeding roller comes into contact with said sheet material stacking means.

14. An apparatus according to claim 9, wherein a driving force from a driving source is transmitted to said feeding roller through clutch means for intermitting transmission of the driving force.

15. An apparatus according to claim 14, wherein said clutch means includes a planet gear clutch.

16. An apparatus according to claim 14, wherein said clutch means includes a spring clutch composed by using a spring.

17. A sheet feeding apparatus comprising:

a stacker for stacking sheets, wherein said stacker comprises a pressure plate;

a feeding roller for feeding the sheets stacked on said stacker;

a separation roller, rotating according to said feeding roller, for separating the sheets;

a separation roller holder for rotatably holding said separation roller, said separation roller holder rotating to cause said separation roller to move to a position being in contact with said feeding roller and to a position being released from said feeding roller;

a spring for urging the pressure plate to said feeding roller to cause the sheets stacked on said stacker to come into contact with said feeding roller; and a cam provided on a shaft of said feeding roller, being engaged with a cam follower portion of the pressure plate to push down the pressure plate, wherein, after said separation roller comes into contact with said feeding roller, it causes the sheets stacked on said stacker to come into contact with said feeding roller.

18. An apparatus according to claim 17, further comprising turn-back means for returning the sheet materials other than the sheet materials separated by said separation roller to said stacker.

19. An apparatus according to claim 17, wherein said separation roller is provided with a torque limiter.

20. An apparatus according to claim 17, wherein said separation roller is provided with a spring for causing said separation roller to come into pressure-contact with said feeding roller.

21. An apparatus according to claim 17, wherein said separation roller comes into contact with said feeding roller on a downstream side of a position where said feeding roller comes into contact with said stacker.

22. An apparatus according to claim 17, wherein a driving force from a driving source is transmitted to said feeding roller through clutch means for intermitting transmission of the driving force.

23. An apparatus according to claim 22, wherein said clutch means includes a planet gear clutch.

24. An apparatus according to claim 22, wherein said clutch means includes a spring clutch composed by using a spring.

25. A recording apparatus which performs recording on a sheet material by using a recording head, comprising:

a head mounting unit for mounting the recording head;

a stacker for stacking sheets, wherein said stacker comprises a pressure plate;

a feeding roller for feeding the sheets stacked on said stacker;

a separation roller, rotating according to said feeding roller, for separating the sheets;

a separation roller holder for rotatably holding said separation roller, said separation roller holder rotating to cause said separation roller to move to a position being in contact with said feeding roller and to a position being released from said feeding roller;

a spring for urging the pressure plate to said feeding roller to cause the sheets stacked on said stacker to come into contact with said feeding roller; and a cam provided on a shaft of said feeding roller, being engaged with a cam follower portion of the pressure plate to push down the pressure plate, wherein, after said separation roller comes into contact with said feeding roller, it causes the sheets stacked on said stacker to come into contact with said feeding roller.

26. An apparatus according to claim 25, further comprising turn-back means for returning the sheet materials other than the sheet materials separated by said separation roller to said stacker.

27. An apparatus according to claim 25, wherein said separation roller is provided with a torque limiter.

28. An apparatus according to claim 25, wherein said separation roller is provided with a spring for causing said separation roller to come into pressure-contact with said feeding roller.

29. An apparatus according to claim 25, wherein said separation roller comes into contact with said feeding roller on a downstream side of a position where said feeding roller comes in contact with said stacker.

30. An apparatus according to claim 25, wherein a driving force from a driving source is transmitted to said feeding roller through clutch means for intermitting transmission of the driving force.

31. An apparatus according to claim 26, wherein said clutch means includes a planet gear clutch.

32. An apparatus according to claim 26, wherein said clutch means includes a spring clutch composed by using a spring.

* * * * *

UNITED STATES PATENT AND TRADEMARK OFFICE

CERTIFICATE OF CORRECTION

PATENT NO. : 6,896,253 B2
DATED : May 24, 2005
INVENTOR(S) : Tadashi Hanabusa

It is certified that error appears in the above-identified patent and that said Letters Patent is hereby corrected as shown below:

Title page,
Item [57], ABSTRACT,
Line 9, “a urge” should read -- an urge --.
Line 10, “urge” should read -- urging --.
Line 12, “came” should read -- comes --.

Column 2,
Line 10, “came” should read -- comes --.
Line 22, “relation” should read -- the relation --.

Column 3,
Line 17, “with” should be deleted.
Line 18, “that” should read -- wherein --.

Column 4,
Line 3, “that” should read -- wherein --.

Column 5,
Line 3, “is to” should read -- is used to --.

Column 7,
Line 40, “out at a time” should read -- out one at a time --.

Column 8,
Line 37, “that” should read -- wherein --.

Column 9,
Line 25, “being” should read -- being held --.
Line 29, “most moved” should read -- furthest moved --.
Line 39, “that” should read -- wherein --; and “most” should read -- furthest --.
Line 46, “that” should read -- wherein --.

Column 10,
Line 40, “surface lid” should read -- surface 11d --.

Column 11,
Line 28, “retracted,” should read -- retracts, --.
Line 36, “that” should read -- wherein --.
Line 57, “lid of” should read -- 11d of --.

UNITED STATES PATENT AND TRADEMARK OFFICE

CERTIFICATE OF CORRECTION

PATENT NO. : 6,896,253 B2
DATED : May 24, 2005
INVENTOR(S) : Tadashi Hanabusa

It is certified that error appears in the above-identified patent and that said Letters Patent is hereby corrected as shown below:

Column 12,
Line 6, “that” should read -- wherein --.

Column 13,
Line 43, “that” should read -- wherein --.

Signed and Sealed this

Eleventh Day of October, 2005

JON W. DUDAS
*Director of the United States Patent and Trademark Office*